US007153257B2

(12) United States Patent
Schneider et al.

(10) Patent No.: US 7,153,257 B2
(45) Date of Patent: Dec. 26, 2006

(54) IMPLANTABLE HEARING AID TRANSDUCER SYSTEM

(75) Inventors: Robert Edwin Schneider, Erie, CO (US); Travis Rian Andrews, Boulder, CO (US)

(73) Assignee: Otologics, LLC, Boulder, CO (US)

( * ) Notice: Subject to any disclaimer, the term of this patent is extended or adjusted under 35 U.S.C. 154(b) by 40 days.

(21) Appl. No.: 10/821,447

(22) Filed: Apr. 9, 2004

(65) Prior Publication Data

US 2005/0228213 A1 Oct. 13, 2005

(51) Int. Cl.
*H04R 25/00* (2006.01)

(52) U.S. Cl. ..... 600/25

(58) Field of Classification Search ..... 600/25; 381/312–331; 181/128–137; 623/10; 606/61
See application file for complete search history.

(56) References Cited

U.S. PATENT DOCUMENTS

| | | | | | |
|---|---|---|---|---|---|
| 4,498,461 | A | * | 2/1985 | Hakansson | 600/25 |
| 4,809,694 | A | | 3/1989 | Ferrara | |
| 4,840,178 | A | | 6/1989 | Heide et al. | |
| 4,988,333 | A | | 1/1991 | Engebretson et al. | |
| 5,217,011 | A | | 6/1993 | Bisch | |
| 5,263,956 | A | * | 11/1993 | Nobles | 606/130 |
| 5,456,654 | A | * | 10/1995 | Ball | 600/25 |
| 5,702,342 | A | * | 12/1997 | Metzler et al. | 600/25 |
| 5,776,144 | A | | 7/1998 | Leysieffer et al. | |
| 5,788,711 | A | | 8/1998 | Lehner et al. | |
| 5,941,814 | A | | 8/1999 | Lehner et al. | |
| 6,077,215 | A | | 6/2000 | Leysieffer | |
| 6,113,531 | A | | 9/2000 | Leysieffer et al. | |
| 6,293,903 | B1 | | 9/2001 | Kasic, II et al. | |
| 6,390,970 | B1 | | 5/2002 | Muller | |
| 6,398,717 | B1 | | 6/2002 | Leysieffer et al. | |
| 6,491,622 | B1 | * | 12/2002 | Kasic et al. | 600/25 |
| 6,517,476 | B1 | | 2/2003 | Bedoya et al. | |
| 6,537,199 | B1 | | 3/2003 | Mueller et al. | |
| 6,537,201 | B1 | | 3/2003 | Kasic, II et al. | |
| 6,547,715 | B1 | | 4/2003 | Mueller et al. | |
| 6,620,094 | B1 | | 9/2003 | Miller | |
| 6,705,985 | B1 | | 3/2004 | Easter et al. | |
| 6,707,920 | B1 | | 3/2004 | Miller | |
| 6,712,754 | B1 | | 3/2004 | Miller et al. | |
| 6,726,618 | B1 | | 4/2004 | Miller | |
| 2004/0147804 | A1 | | 7/2004 | Schneider et al. | |

* cited by examiner

*Primary Examiner*—Samuel G. Gilbert
(74) *Attorney, Agent, or Firm*—Marsh, Fischmann & Breyfogle LLP

(57) ABSTRACT

An implantable hearing aid system that includes a transducer housing that is rotatable relative to a transducer mounting apparatus to orient the transducer for interfacing with an auditory component. According to one aspect of the invention, during rotation, a center of rotation of the transducer housing remains positionally fixed. In this regard, the transducer includes an actuator member that is advanceable relative to the transducer housing to interface with the auditory component, subsequent to orientation of the transducer housing.

37 Claims, 12 Drawing Sheets

IMPLANTABLE HEARING AID TRANSDUCER SYSTEM

FIELD OF THE INVENTION

The invention is related to the field of implantable hearing aids, and in particular, to an implantable hearing aid transducer and mounting system that rotatably cooperate to orient the transducer for interfacing with a component of the auditory system.

BACKGROUND OF THE INVENTION

In the class of hearing aids generally referred to as implantable hearing aids, some or all of various hearing augmentation componentry is positioned subcutaneously on or within a patient's skull, typically at locations proximate the mastoid process. Implantable hearing aids may be generally divided into two sub-classes, namely, semi-implantable and fully implantable. In a semi-implantable hearing aid, components such as a microphone, signal processor, and transmitter may be externally located to receive, process, and inductively transmit an audio signal to implanted components such as a transducer. In a fully implantable hearing aid, typically all of the components, e.g. the microphone, signal processor, and transducer, are located subcutaneously. In either arrangement, an implantable transducer is utilized to stimulate a component of the patient's auditory system to cause or enhance the sensation of sound for a patient.

A number of different types of implantable transducers have been proposed. By way of primary example, such devices include those that utilize a driver, e.g. an electromechanical or piezoelectric driver, to move an actuator designed to stimulate the ossicular chain of a patient. By way of example, one type of electromechanical transducer includes a driver that moves an actuator positioned to mechanically stimulate the ossicles of a patient via axial vibratory movements. (See e.g. U.S. Pat. No. 5,702,342). In this regard, one or more bones of the ossicles are made to mechanically vibrate, thereby stimulating the cochlea through its natural input, the so-called oval window.

Orienting and positioning an implantable transducer for interfacing with a component of the auditory system, e.g. the ossicles, poses numerous challenges. For instance, during implantation it is often necessary to locate a transducer both laterally and/or vertically relative to the auditory component, and once located, maintain such location for an indefinite amount of time, e.g. during the life of the implant. Furthermore, implantable transducers include components, such as the driver and transducer electronics, which may be damaged by exposure to biological fluids, and therefore, it is desirable to limit exposure to the same. Providing an interconnection between a movable member, such as an actuator, and the transducer, however, that is both movable and sealed is difficult as such an interconnection necessitates forming a seal between the actuator and the transducer housing that does not interfere with driving or moving of the actuator in response to transducer drive signals.

SUMMARY OF THE INVENTION

In view of the foregoing, an object of the present invention is to simplify, and otherwise improve, hearing aid transducers. Another object of the present invention is to simplify, and otherwise improve, hearing aid transducer implantation procedures. A related object of the present invention is to simplify and otherwise improve orientation and alignment methods and apparatus for hearing aid transducer implantation.

According to one aspect of the present invention, an implantable hearing aid transducer is provided. The transducer includes an actuator to stimulate an auditory component and a driver, including at least one magnet and one coil, to drive the actuator in response to transducer drive signals. According to this aspect, at least a portion of a housing of the transducer, enclosing at least a portion of the driver, is rotatable relative to a transducer mounting apparatus. During such rotation, a center of rotation of the rotatable portion of the transducer housing remains positionally fixed, other than pure rotation. In other words, the rotatable portion of the transducer housing is rotatable relative to the mounting apparatus such that the center of rotation does not move laterally or longitudinally during rotation. Rather, during rotation, any point on, for example the surface of the rotatable portion of the housing, will reposition or will move relative to the mounting apparatus along an arc between first and second positions about the center of rotation, which in turn remains positionally fixed, other than pure rotational movement.

According to one feature of the subject aspect, the rotatable portion of the transducer housing may be configured for rotation within a cavity of the mounting apparatus. This in turn permits orientation of transducer components, e.g. the actuator, for interfacing with an auditory component of a patient, e.g. the ossicles. The cavity may be a substantially enclosed cavity, e.g. enclosed on all but one side, or alternatively may be defined by at least two opposing portions, e.g. two substantially rounded portions, rotatably mateable with the rotatable portion of the transducer housing. According to this characterization, the orientation may include rotating the rotatable portion of the transducer housing within the cavity to align an actuator or actuator intercept axis with a desired interface point on the auditory component.

The rotatable portion of the transducer housing may be of any geometric shape or configuration that is rotatable relative to the mounting apparatus cavity. For instance, the rotatable portion of the transducer housing may comprise a rounded housing surface. In another instance, the rotatable portion of the transducer housing may comprise a substantially round surface having a plurality of faucets or faces, such as on a diamond. According to this characterization, as the portion of the transducer housing is rotated, each face may operate to positionally fix the housing along a continuum of positions defined by the faucets. In another instance, the entire transducer housing may be configured for rotation, e.g. rounded. In another instance, the rotatable portion of the transducer housing may include substantially rounded opposing portions to permit rotation within the cavity. In this case, the substantially rounded opposing portions may have the same or a variety of different arc lengths or radii.

According to another feature of the present aspect, the actuator may be advanceable relative to the transducer housing to facilitate interfacing with the auditory component. For example, the actuator may be a separate structure from the transducer housing that is selectively connectable to the transducer housing. In this regard, the transducer housing may include an aperture defined therein from a first end to a second end for receiving the actuator. According to this characterization, the actuator may be designed for insertion through the aperture in the transducer housing, where it may be positioned proximate or adjacent to the ossicies of a patient for interfacing with a component thereof. Such interfacing may include a physical engagement and/or an adjacent positioning of the actuator relative to the ossicles.

The actuator may be an elongated unitary member and may be constructed from any material of sufficient rigidity for transmission of vibrations to the ossicles. Some s examples of the actuator include a wire, tube, pin etc. formed from a biocompatible material, e.g. titanium. In this regard, it may be desirable that the length of the actuator be sufficiently longer than necessary for interfacing with the auditory component, as the excess length may be trimmed subsequent to interfacing with the auditory component.

Advantageously, the rotatable portion of the transducer housing may be utilized to orient the transducer through rotational movements with respect to an auditory component. The advanceable actuator, on the other hand, provides a means for accommodating the depth dimension. In other words, upon location in the cavity of the mounting apparatus, the transducer housing may be rotated to align the actuator axis and a desired interface point on an auditory component. Subsequently, the actuator may be inserted through the transducer housing along the actuator axis and interfaced with the desired interface point on the auditory component.

According to another aspect of the present invention, an implantable hearing aid transducer is provided that includes a separate means for sealing internal transducer components and providing a movable connection with an actuator of the transducer. Those skilled in the art will appreciate, however, how the present aspect may be combined with the above aspect to provide additional features and advantages according to the present invention. In this regard, the transducer includes a transducer housing and a driver, including at least one coil and one magnet, to drive the actuator in response to transducer drive signals. The transducer further includes a seal disposed around one of the magnet and the coil. The sealed one of the magnet and the coil is in turn connectable to the actuator, either directly or indirectly, to protect the same from body fluids introduced into the transducer. Similarly, the other one of the coil and magnet may include its own seal, e.g. via its location within the transducer housing.

As with the above aspect, the transducer housing may include an aperture between first and second ends and the actuator may be a separate structure from the transducer housing. In this regard, one of the actuator and the transducer may include a means for connecting the actuator to the transducer in a movable manner. For instance, in one example, a tube appropriately sized to receive the actuator, may be connected within the aperture in a movable manner. The tube may further include a means for connecting the actuator and the tube together, subsequent to insertion of the actuator into and through the tube a desired distance. Moreover, the means for connecting may be selectively activatable to allow both connection and disconnection of the actuator and tube.

As noted above, the transducer includes a seal disposed around one of the magnet and the coil, which is in turn, connectable to the actuator. In this regard, the one of the magnet and the coil may be connected to the tube in a sealed manner, which is in turn connectable to the actuator. According to this characterization, the one of the magnet and coil connected to the tube may be utilized to induce axial vibrational movement of the tube and connected actuator. In particular, such axial movement may be induced by electromagnetic fields provided by the other one of the magnet and coil in response to transducer drive signals.

In this regard, one example of the connecting means for providing the movable connection between the actuator and the transducer may include a compliant member. According to the present characterization, the compliant member may be connected between the tube and the interior wall of the aperture defined in the transducer housing, such that the compliant member supports the tube therein in a movable manner. In other words, the compliant member is designed to provide a movable connection between the transducer housing and the tube, which in turn is rigidly connected to the actuator so that movement of the tube causes a corresponding movement of the actuator.

In this regard, one example of the compliant member may include a spring washer. The spring washer may be a flat circular spring member having a plurality of helical cutouts defining a plurality of helical leaf springs. In this regard, an exterior portion of the spring washer may be connected to the transducer housing, while an interior portion is connected to the tube. In particular, an outside annular peripheral edge may be connected to an end of the transducer housing while an interior annular edge may be connected to a co-aligned end of the tube. The rest of the tube, including the distal end, may rely on the support provided by the spring washer and may be unconnected or float within the aperture of the transducer housing. Alternatively, however, a second spring washer may be utilized to form a second interconnection between the distal end of the tube and a distal end of the transducer housing. In either case, operationally, the spring washer is configured to flex or expand inward and outward relative to the interconnected transducer housing, as the tube and connected actuator are axially vibrated relative thereto by the magnet and coil of the driver.

Another example of the compliant member may include a material having compliant properties, e.g. compliant material, disposed/connected between the tube and the interior wall of the aperture defined in the transducer housing. For instance, according to one example, a compliant material such as silicon may be located at a predeterminable location along the tube with a first portion adhering to the tube and a second portion adhering to the interior wall of the aperture. It will be appreciated that numerous materials having compliant, elastomeric, or rubber properties may be utilized according to the present principles. Additionally, it will be appreciated that selection of different materials may be utilized to provide movable connections having a varying range of motion and may be selected in combination with the transducer driver power output to achieve a variety of stimulation characteristics for a given actuator.

It should be noted that, advantageously, the entire seal of the present aspect moves with the one of the magnet and coil connected to the actuator or tube, and therefore, fatigue on the material is reduced to enhance the durability and reliability of the seal. Those skilled in the art will appreciate the significant advantage over seals, having portions of the seal move relative to other portions of the seal to accommodate movement between components connected to the different portions. In other words, while the seal of the present invention moves with the movable members of the transducer, the seal is less susceptible to mechanical failure due to the movement of the entire seal, as opposed to only a portion of the seal.

According to another aspect of the present invention, a retention apparatus for an implantable hearing aid transducer system is provided to capture a rotatable member in a desired angular orientation relative to an auditory component. As with the above aspects, those skilled in the art will appreciate how the present aspect may be combined with other aspects set forth herein to provide additional features and advantages of the present invention. In this regard, the retention apparatus comprises a retaining member having at least one guide that is movable between an unlocked and locked position along a predetermined path of travel defined in a transducer mounting apparatus. The retention apparatus also includes a resilient member that is compressible between the retaining member and the rotatable when the rotatable member is located in the mounting apparatus. The compression of the resilient member operates to capture the rotatable member in a desired angular orientation relative to an auditory component when the retention apparatus is in the locked position.

According to one feature of the retention apparatus, the retaining member may comprise a pair of diametrically opposed guides located on an annular collar. The guides are movable along one or more predetermined paths of travel defined in the mounting apparatus. For example, the mounting apparatus may include the above-described cavity, while the paths of travel may comprise one or more channels defined along the interior wall of the cavity. In particular, the one or more channels may be intersecting vertical and horizontal or latitudinal and longitudinal channels or slots that operate to form a twist lock type connection between the retaining member and the mounting apparatus. In this regard, the guides may travel along the vertical channel as the retaining member is inserted into the cavity of the mounting apparatus, and then in response to twisting the retaining member, the guides may travel along the horizontal channels to a locked position.

According to another feature of the present aspect, the horizontal channels may include a slope or angle, relative to a horizontal axis, toward a bottom of the cavity of the mounting apparatus. The slope or angle of the horizontal channels toward the bottom of the cavity operates to draw the retaining member toward the bottom of the cavity as the retaining member is twisted into the locked position. This in turn compresses the resilient member between the rotatable member and retaining member to capture the rotatable member within the cavity. In this regard, the retaining member may include an interface, e.g. such a slot or notches, to mate with a tool to facilitate movement of the retaining member between the unlocked and locked positions.

According to another feature of the present aspect, the horizontal channels may include at least one feature defined in their distal ends to engage the guides of the retaining member in a positive manner. In particular, an undercut may be included therein to positively engage and retain the guides of the retaining member in the locked position.

According to another feature of the present aspect, the retaining member may be connected to the resilient member or integrally formed as a single unit. Alternatively, the retaining member and resilient member may be separate structures that cooperatively operate to capture the rotatable member in the desired orientation. In this regard, the rotatable member may be a portion of a transducer housing such as the above-described housing that is designed for rotation relative to the mounting apparatus. In this regard, the retention apparatus may be designed to exert sufficient force on the rotatable member to capture the rotatable member in a fixed orientation, while still permitting rotation of the rotatable member upon application of a predetermined amount of force. Advantageously, this allows for pre-assembly of the mounting apparatus, the rotatable member, and the retention apparatus, prior to implantation in the patient to reduce implantation steps, while permitting orientation of the rotatable member subsequent to implantation, to align the actuator with a desired interface point on the auditory component.

According to another feature of the present aspect, the retention apparatus may further include a base interconnected to the resilient member distal to the retaining member. According to this characterization, the base may further include a second interface to increase the frictional coefficient between the pivotable member and the base when the connector is in the locked position. For instance, the base may include a roughed surface or material having a higher frictional coefficient than the base, such that the retention force between the connector and the pivotable member is increased.

In accordance with another aspect of the present invention, an implantable hearing aid transducer system is provided. The system according to the present aspect includes a mounting apparatus, a retention apparatus, and a transducer. The mounting apparatus is attachable to a patient's skull and may include a cavity as set forth above. The transducer may include a housing having at least a portion that is rotatable relative to the mounting apparatus as set forth above. Finally, the retention apparatus may be configured as set forth above, to selectively fix a desired angular orientation, of the rotatable portion of the transducer housing, relative to the mounting apparatus.

According to another aspect of the present invention, a method for implanting a hearing aid transducer within a patient is provided. The method includes the steps of attaching a transducer mounting apparatus to a patient's skull, supporting a transducer housing with the mounting apparatus, and rotating at least a portion of the transducer housing relative to the mounting apparatus to orient the transducer for interfacing with an auditory component.

According to one feature of the present method, the supporting step may include supporting the transducer housing within a cavity of the mounting apparatus, while the rotating step includes rotating the rotatable portion of the transducer housing within the cavity to a desired orientation relative to the auditory component. According to this characterization, the rotating step may include aligning an actuator or an actuator axis with a desired interface point on the auditory component.

According to another feature of the present method, the method may further include the step of securing the transducer housing in the desired orientation relative to the auditory component. In this regard, the securing step may include securing the transducer housing in the desired orientation in a detachable manner.

According to another feature of the present method, the method may include the steps of inserting an actuator through the aperture in the transducer housing, and advancing the actuator through the aperture for interfacing with an auditory component. Such interfacing may include the step of adjacently positioning the actuator relative to the auditory component or alternatively interfacing the actuator to the auditory component. According to this characterization, the method may further include coupling the interfaced actuator to the transducer housing in a detachable manner.

In accordance with another aspect of the present invention, a method for implanting a hearing aid transducer within a patient is provided. The method of the subject aspect includes the steps of angularly orienting a transducer using pivotable movement relative to a transducer mounting apparatus. In this regard, the method may further include vertically orienting the transducer using an actuator advanceable relative to the transducer to interface with an auditory component.

According to one feature of the present aspect, the angularly orienting step may include rotating a rotatable portion of a transducer housing relative to a mounting apparatus to orient the transducer for interfacing with an auditory component. According to this characterization, the angularly orienting step may include rotating the rotatable portion of the transducer housing within a cavity of the mounting apparatus to align an actuator or an actuator axis with a desired interface point on the auditory component.

In accordance with another aspect of the present invention, a method for implanting a hearing aid transducer in a patient is provided. The method includes the steps of connecting a mounting apparatus to a patient's skull, orienting a rotatable member relative to a desired interface point on an auditory component, and attaching a spring loaded retention apparatus to the mounting apparatus to capture the rotatable member in a desired orientation relative to the mounting apparatus.

According to the present method, the mounting apparatus, the rotatable member, and the spring loaded retention apparatus may be pre-assembled prior to the connecting step. In conjunction with such pre-assembly, the method may include the step of implanting the pre-assembled mounting apparatus, rotatable member, and spring loaded retention apparatus, within the mastoid process of a patient. In this regard, the method may include the step of rotating the rotatable member to a desired orientation subsequent to attachment of the retention apparatus.

In one approach according to the present method, the method may further include defining a predetermined path of travel between an unlocked position and a locked position for the spring loaded retention apparatus. In conjunction with this approach, the method may include moving at least one guide of the spring loaded retention apparatus along the predetermined path of travel to lock and unlock the retention apparatus. During such movement, the retention apparatus and predetermined path of travel may be configured to compress a spring of the retention apparatus in response to the movement of the retention apparatus along the predetermined path. The moving step may also include positively engaging the guide in a feature of the mounting apparatus to lock the retention apparatus. Additional aspects, advantages and applications of the present apparatuses and methods will be apparent to those skilled in the art upon consideration of the following.

DETAILED DESCRIPTION

Reference will now be made to the accompanying drawings, which at least assist in illustrating the various pertinent features of the present invention. In this regard, the following description is presented for purposes of illustration and description and is not intended to limit the invention to the form disclosed herein. Consequently, variations and modifications commensurate with the following teachings, and skill and knowledge of the relevant art, are within the scope of the present invention. The embodiments described herein are further intended to enable others skilled in the art to utilize the invention in such, or other embodiments, and with various modifications required by the particular application(s) or use(s) of the present invention.

Figure 1:
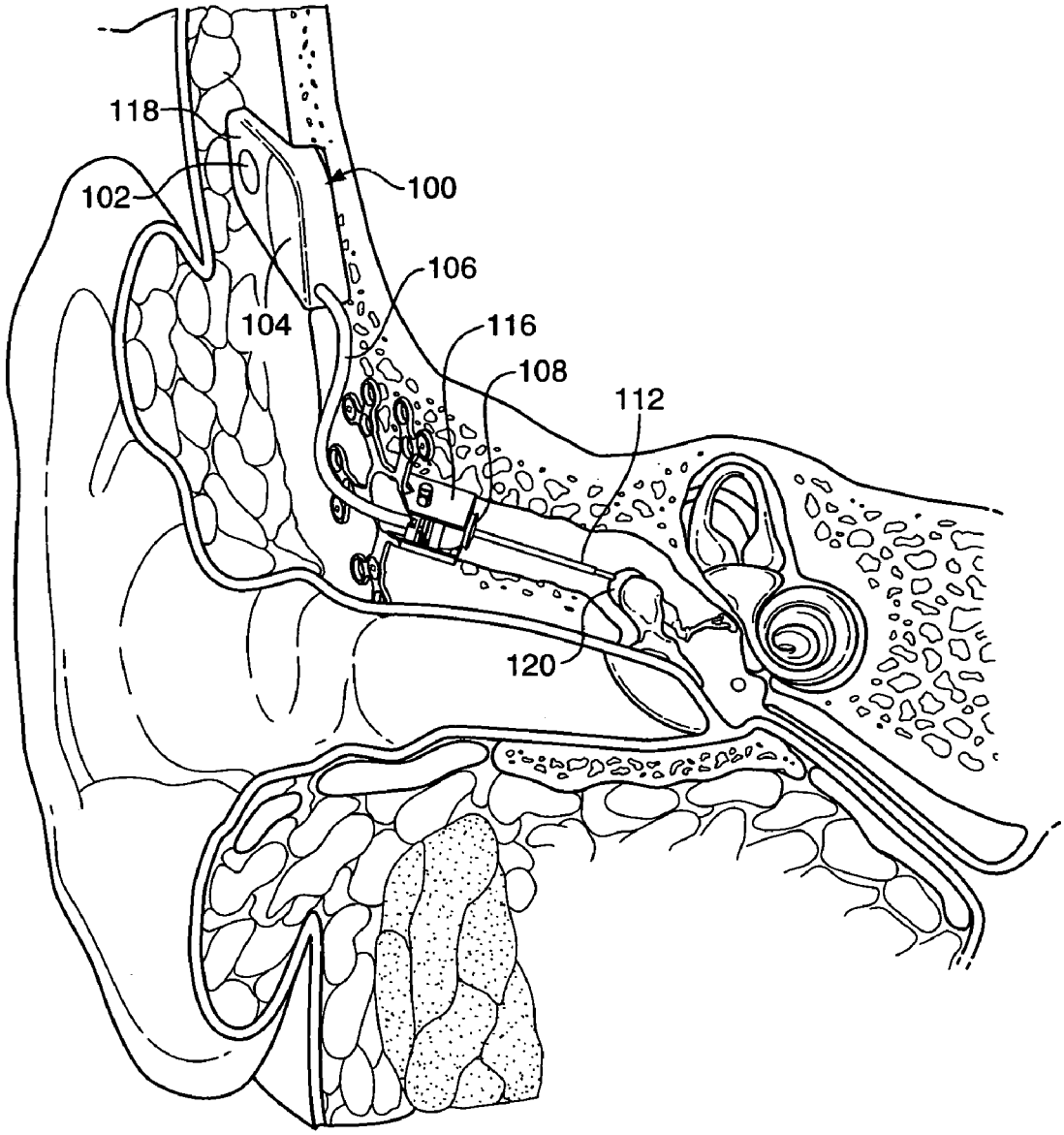
FIGS. 1, 2*a* and 2*b* illustrate implantable and external componentry respectively, of a semi-implantable hearing aid device.
Figure 2A:
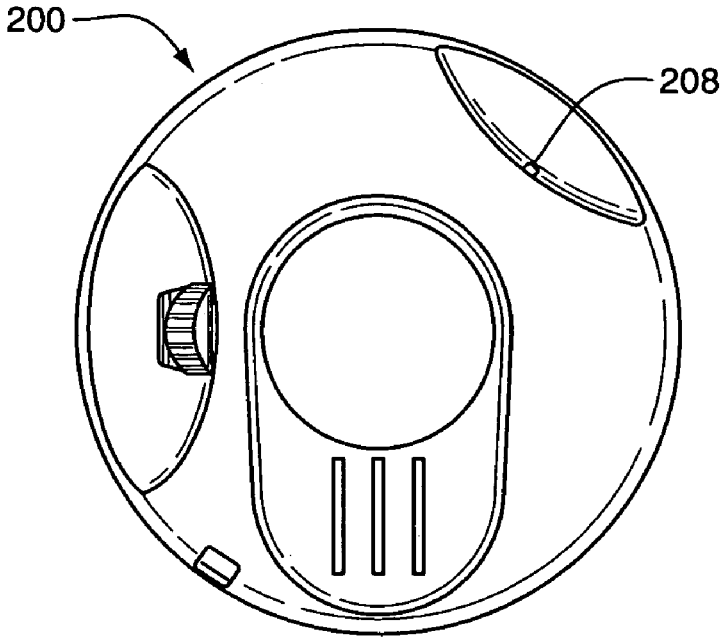
Figure 2B:
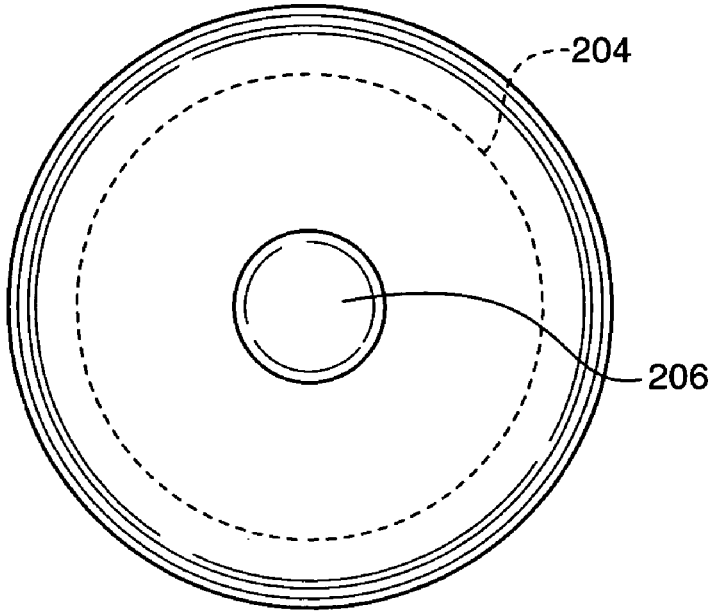

FIGS. 1, 2*a*, and 2*b* illustrate implantable and external componentry of a semi-implantable hearing aid system. The illustrated system includes implanted components shown in FIG. 1, and external components shown in FIGS. 2*a* and 2*b*. As will be appreciated, the present invention may also be employed in conjunction with fully implantable systems, wherein all components of the hearing aid system are located subcutaneously.

In the illustrated example, an implanted biocompatible housing 100 is located subcutaneously on a patient's skull. The housing 100 includes an RF signal receiver 118 (e.g. comprising a coil element) and a signal processor 104 (e.g. comprising processing circuitry and/or a microprocessor). The signal processor 104 is electrically interconnected via wire 106 to a transducer 108.

The transducer 108 is supportably positioned in a mounting apparatus 116. The mounting apparatus 116 is attached to the patient's skull (e.g. via a hole drilled therein) typically within the mastoid process. The transducer 108 includes an actuator 112 designed to transmit axial vibrations to a member of the ossicles of the patient (e.g. the incus 120). The transducer 108 also includes a driver (not shown on FIG. 1) to drive the actuator 112 in response to transducer drive signals. The driver may be of any suitable design that causes the actuator 112 to stimulate an associated middle ear component, such as the incus bone 120, to produce or enhance the sensation of sound for the patient. For instance, some examples of the driver may include without limitation, an electrical, piezoelectric, electromechanical, and/or electromagnetic driver.

Referring to FIGS. 2*a* and 2*b*, the semi-implantable system further includes an external housing 200 comprising a microphone 208 and internally mounted speech signal processing (SSP) unit (not shown). The SSP unit is electrically interconnected to an RF signal transmitter 204 (e.g. comprising a coil element). The external housing 200 is configured for disposition proximate the patient's ear. The external transmitter 204 and implanted receiver 118 each include magnets, 206 and 102, respectively, to facilitate retentive juxtaposed positioning.

During normal operation, acoustic signals are received at the microphone 208 and processed by the SSP unit within external housing 200. As will be appreciated, the SSP unit may utilize digital processing to provide frequency shaping, amplification, compression, and other signal conditioning, including conditioning based on patient-specific fitting parameters. In turn, the SSP unit provides RF signals to the transmitter 204. Such RF signals may comprise carrier and processed audio drive signal portions. The RF signals are transcutaneously transmitted by the external transmitter 204 to the implanted receiver 118. As noted, the external transmitter 204 and implanted receiver 118 may each comprise coils for inductively coupling signals therebetween.

Upon receipt of the RF signals, the implanted signal processor 104 processes the signals (e.g. via envelope detection circuitry) to provide a processed drive signal via wire 106 to the transducer 108. According to this example, the drive signals induce axial vibrations of the actuator 112 at acoustic frequencies to cause a desired sound sensation via mechanical stimulation of the incus 120, which in turn drives the cochlea of the patient to produce and/or enhance the sensation of sound through the natural mechanical motions of the ossicles. As will also be appreciated, the vibrations are effectively communicated to the ossicles when an appropriate interface exists with the actuator 112. That is, if a desirable interface has been established, the actuator 112 will readily communicate axial vibrations to the incus 120. On the other hand, if the actuator 112 is "underloaded" (a loose or no interconnection has been established), axial vibrations may not be communicated. Furthermore, if the actuator 112 is "overloaded" against the incus 120, transmission may be adversely effected.

Figure 3:
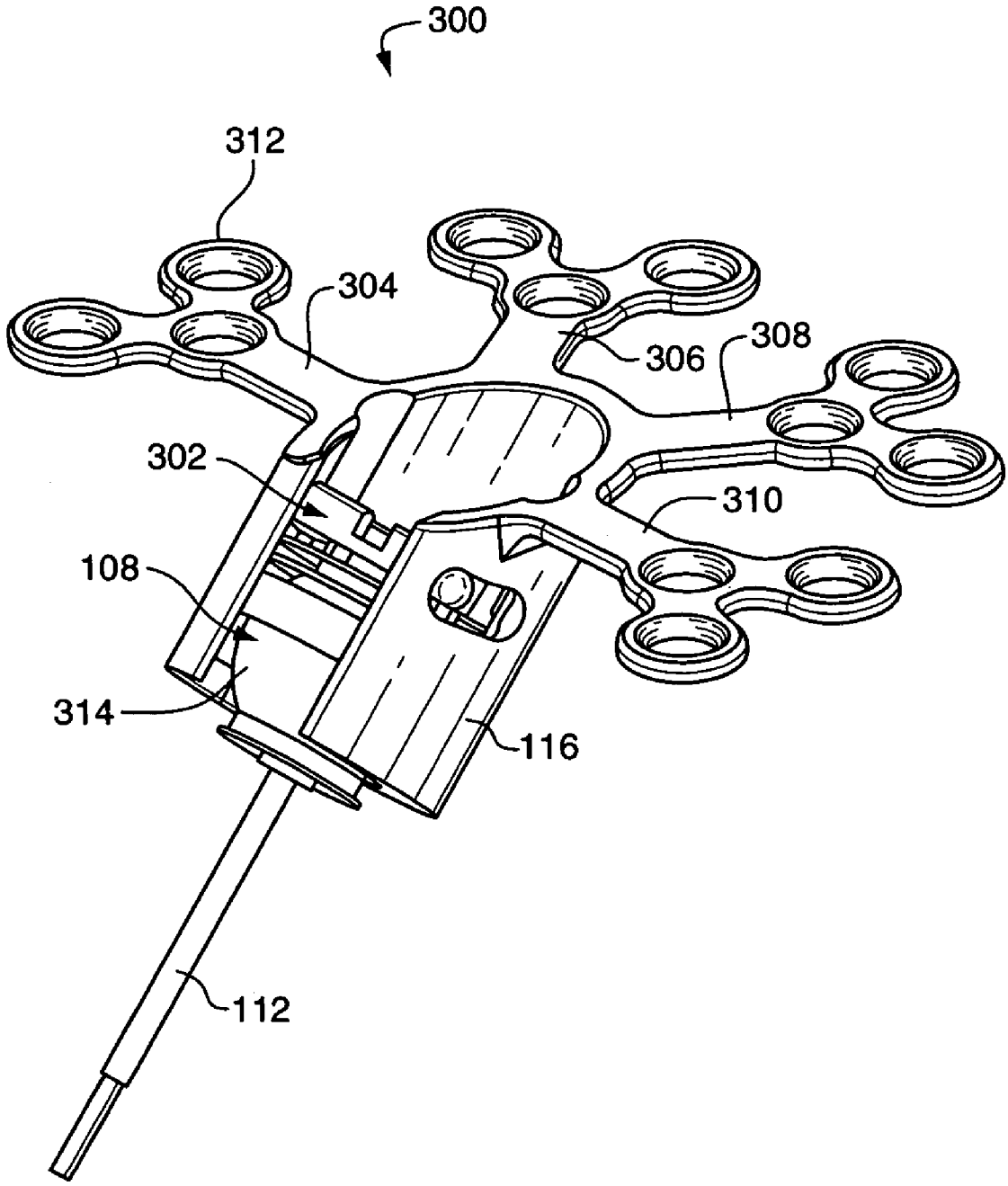
FIG. 3 illustrates an example of an implantable transducer system.

FIG. 3 illustrates an example of a transducer system 300 for implanting an implantable transducer, such as transducer 108. The transducer system 300 includes the mounting apparatus 116, the transducer 108, and a retention apparatus 302. The mounting apparatus 116 is configured for attachment to a patient's skull to locate the transducer 108 such that the actuator 112 may access the middle ear and interface with an auditory component of the patient, e.g. the incus 120. Accordingly, the mounting apparatus 116 includes mounting legs 304, 306, 308, and 310, extending radially outward and including a plurality of apertures, as exemplified by aperture 312, to permit attachment of the mounting apparatus 116 to a patient's skull, e.g. using bone screws.

The transducer 108 includes a housing 314 that is geometrically shaped for rotational movement relative to the mounting apparatus 116, when the transducer 108 is located therein. As further described herein, such rotational movement provides a means for angularly orienting the transducer 108 for interfacing the actuator 112 with the ossicles, or in particular, the incus 120. In other words, during implantation the transducer 108 is rotatable within the mounting apparatus 116 to align the actuator 112 with a desired interface point on the incus 120. For purposes of illustration, a rounded transducer housing 314 is utilized throughout this example. As further discussed below, however, the transducer housing 314 may be configured in numerous other geometric configurations that are shaped for rotational movement relative to the mounting apparatus 116.

Once the transducer housing 314 is rotated to a desired orientation relative to the mounting apparatus 116, the retention apparatus 302 is utilized to maintain the position of the housing 314 in the desired orientation. In particular, the retention apparatus 302 is designed to provide a quick and efficient means for fixing the position of the housing 314 relative to the mounting apparatus 116. As will also be described below, the retention apparatus 302 is designed to provide a quick and efficient means for releasing the housing 314 for removal from the mounting apparatus 116.

Figure 4:
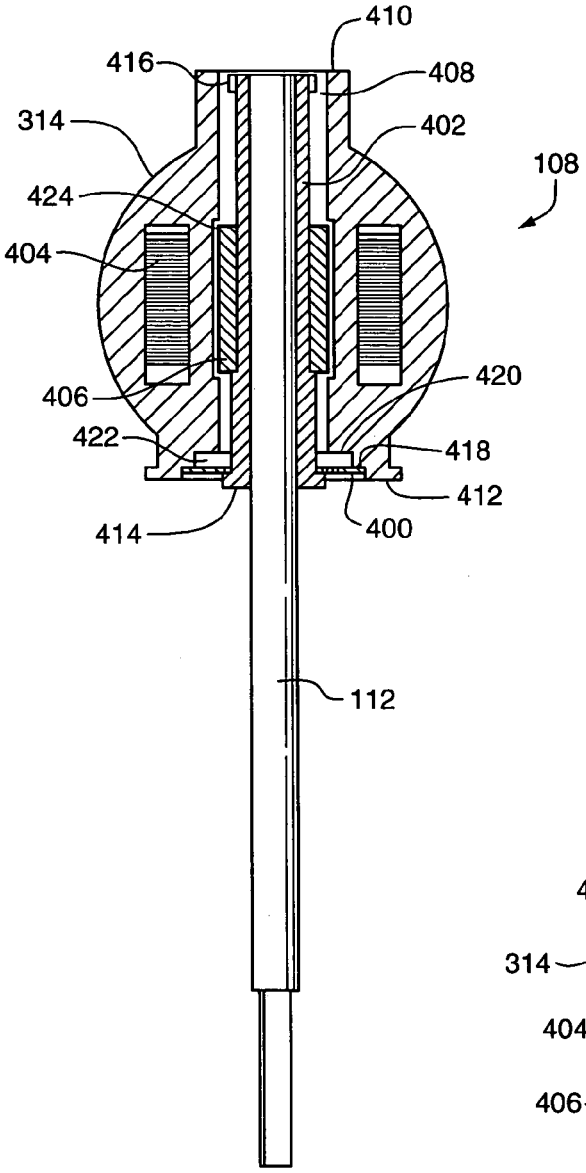
FIG. 4 illustrates a cross sectional view of the implantable transducer of FIG. 3.
Figure 5:
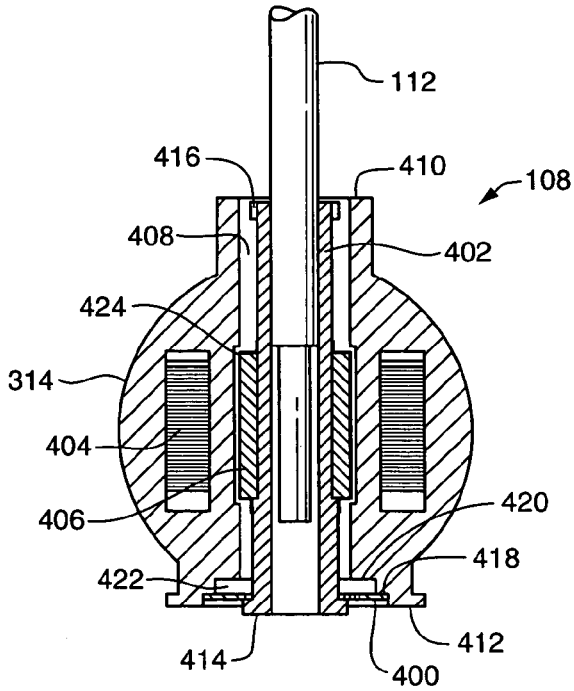
FIG. 5 illustrates another cross sectional view of the implantable transducer of FIG. 3.

Referring to FIGS. 4 and 5, the actuator 112 of the transducer 108 is preferably a separate structure from the transducer housing 314. In this regard, subsequent to orienting or aligning the transducer housing 314, the actuator 112 is insertable into and through the transducer housing 314 for interfacing with the incus 120, e.g. at a desired s interface point. Once interfaced with the incus 120, the actuator 112 is connected in a movable manner to the transducer housing 314 to permit transmission of axial vibrations from the transducer 108 to the incus 120. According to this characterization, the actuator 112 may be any appropriate structure of sufficient rigidity to transmit axial vibrations from the transducer 108 to the incus 120. For instance, some examples of the actuator 112 may include without limitation a pin, a tube, a wire, etc., preferably constructed from a biocompatible material including without limitation, titanium, a titanium alloy, platinum, a platinum alloy, or gold-plated stainless steel.

The transducer 108 includes a tube 402 located within a central aperture 408 defined between a first end 410 and a second 412 of the transducer housing 314. The tube 402 is appropriately sized to receive the actuator 112 therein and includes a means 416 for connecting the actuator 112 to the tube 402. The tube 402 is in turn connected in a movable manner to the transducer housing 314 to permit a transducer driver to induce axial movements of the tube 402 and connected actuator 112. As will be described herein below the tube 402 is connected in a movable manner to the transducer housing 314.

The means 416 for connecting the actuator 112 to the tube 402 may be any one of a number of connecting apparatus and or materials including without limitation, a mechanical clamp, an adhesive, or an electromechanical connector. In at least one example of the present embodiment illustrated on FIG. 4, the means 416 may be a clamp that operates to compress the end of the tube 402 inward so that the end of the tube 402 engages the actuator 112 to connect the tube 402 and actuator 112 together. In particular, the clamp may be an annular shape memory alloy such as, NiTinol (trade name for the standard alloy Nickel-Titanium) disposed around one end of the tube 402. Shape memory alloys are known for their ability to take on a predetermined shape in response to a stimulus such as a temperature change. Specifically, shape memory alloys, such as NiTinol, undergo a phase transformation when cooled from their high temperature form, Austenite, to their low temperature form, Martensite. When such alloys are in the Martensite form, they are easily deformed to a new shape. When the alloy is heated, however, it recovers its previous shape, hence the name shape memory alloy. Advantageously, for alloys such as NiTinol, the temperature at which the alloy returns to its original shape may be adjusted, typically between a range of 100 degrees Celsius to negative 100 degrees Celsius. In the present context, the shape memory alloy means 416 may be configured to maintain an original shape at body temperatures. The original shape may be a predefined shape that operates to compress the end of the tube 402 inward so that the end of the tube 402 engages the actuator 112 to connect the tube 402 and actuator 112 together. Similarly, when the temperature of the shape memory alloy is raised substantially above body temperature, the alloy releases the engagement between the end of the tube 402 and actuator 112, e.g. becomes deformable, to permit removal of the actuator 112 from the tube 402.

According to this characterization, the transducer driver includes a magnet 406 connected to the tube 402, and a coil 404 located within a wall of the transducer housing 314. In particular, the magnet 406 may be an annular structure that is disposed around the tube 402 and connected thereto such that movement of the connected magnet 406, tube 402, and actuator 112, may be induced by electromagnetic fields from the coil 404 acting on the magnet 406. The coil 404, in turn, may be electrically connected to the signal processor 104, which provides transducer drive signals to the coil 404 to induce desired magnetic fields across the magnet 406 during operation of the transducer 108.

The magnet 406 may be a single structure or alternatively may be a plurality of individual magnets disposed around and connected to the tube 402. In a further alternative example, the tube 402 itself may be magnetized, (constructed from a material having magnetic properties), such that the coil 404 induces movement of the tube 402 directly and a separate magnet 406 is not needed. In still yet a further alternative example, it will be appreciated that the driver components (e.g. magnet 406 and coil 404) may be reversed such that the magnet 406 is located in the wall of the transducer housing 314 and the coil 404 is connected to the tube 402.

Figure 6:
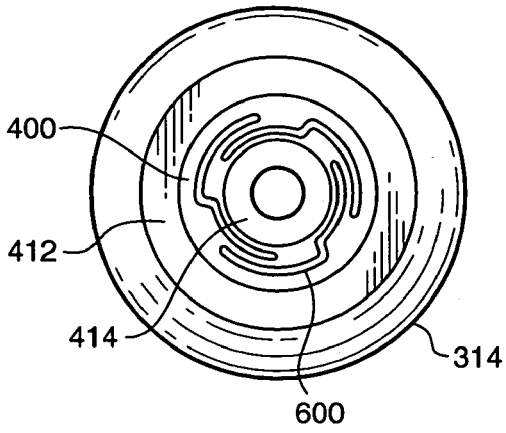
FIG. 6 illustrates a bottom view of the implantable transducer of FIG. 3.

Referring also to FIG. 6 illustrating a bottom view of the transducer 108, the movable connection between the tube 402 and the transducer housing 314 may be provided by a spring washer 400. The spring washer 400 is connected between a bottom portion of the housing 314 and an end of the tube 402. In particular, the spring washer 400 is connected about its periphery to the end 412 of the transducer housing 314. It will be appreciated that the connection may be provided by a weld, adhesive, electrodeposition, etc. In this regard, the end 412 includes a first recessed lip 418 (shown on FIG. 4) to support the spring washer 400 about its periphery and provide a point of connection for the same. A second recessed lip 420 is also provided in the end 412 to define a small annular space 422 to accommodate flexing of the spring washer 400, outward and inward relative to the end 412 of the transducer housing 314, during axial vibrations of the tube 402 and actuator 112. Similarly, the spring washer 400 is interconnected about an interior portion to the end of the tube 402. In particular, the end of the tube 402 includes a flange 414 to provide support and a point of connection for the interior portion of the spring washer 400 at the end of the tube 402. As with the interconnection to the lip 418, the interconnection of the spring washer 400 to the flange 414 may be made by numerous means including for example, a weld, an adhesive, electrodeposition, etc.

To permit the axial movement of the tube 402, the spring washer 400 includes a plurality of helical cutouts that define a plurality of helical leafs 600 between the connected periphery and interior portions of the spring washer 400. The helical leafs 600 allow the interior portion of the spring washer 400 to flex inward and outward, relative to the rigidly fixed periphery. In particular, the helical leafs 600 flex relative to the fixed periphery of the spring washer 400 with the advancing and retracting of the tube 402 and actuator 112 induced by the transducer driver. Of importance, is that while the spring washer 400 permits axial movement of the tube 402 and actuator 112 relative to the transducer housing 314, it restricts lateral or side-to-side movements relative to the housing 314. As will be appreciated by those skilled in the art, minimizing such lateral movement of the actuator 112 is highly desirable in a system designed to axially stimulate an auditory component, such as the incus 120.

Figure 7:
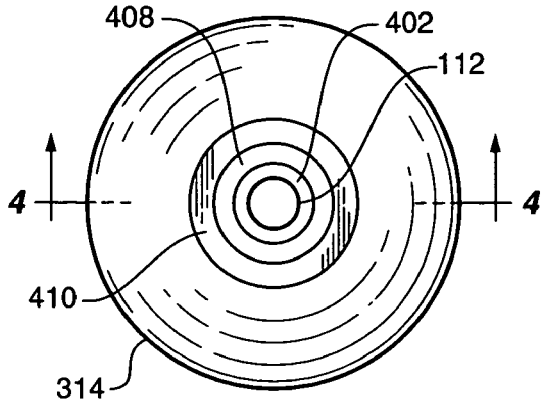
FIG. 7 illustrates a top view of the implantable transducer of FIG. 3.

Referring also to FIG. 7, there is shown a top view of the transducer 108. In this regard, a distal end of the tube 402 may not be connected to the transducer housing 314 at all, but rather, may float within the aperture 408. According to this characterization, the tube 402 relies on the support provided by the interconnection between the spring washer 400 and flange 414 at the opposing end of the tube 402 during the axial vibratory movements of the same. Alternatively, however, it will be appreciated that a second spring washer may be utilized to provide an axially movable connection between the distal end of the tube 402 and the transducer housing 314 if so desired.

Helical leafs 600 of the spring washer 400 permit body fluids to enter the transducer housing 314 through the openings in the same. Accordingly, a separate means for sealing the internal transducer components may be provided. In this case, one of the magnet 406 and the coil 404 is individually sealed in a biocompatible manner within the transducer housing 314. The other one of the magnet 406 and the coil 404 is individually sealed in a biocompatible manner to the tube 402. It will be appreciated that this provides the advantage of separating the means for providing the movable connection between the actuator 112 and the transducer housing 314 and the means for sealing transducer housing 314 from the introduction of body fluids. This in turn, reduces the design requirements for the individual means for providing the movable connection and sealing of the transducer housing 314. In other words, providing a separate means for sealing transducer components and means for providing a movable connection between the actuator 112 and transducer housing 314 enhances design flexibility, as a single means for providing a sealed and movable connection is not required.

In this regard, the magnet 406 may include a hermetic seal 424 disposed around the magnet 406 to form a sealed connection of the magnet 406 to the tube 402, as illustrated by the dark line around the magnet 406 on FIGS. 4 and 5. In one example, the seal 424 may be thin gold plating or other suitable biocompatible plating material disposable over the magnet 406 to form the sealed connection with the tube 402. Alternatively, the seal 424 may comprises an enclosure, made of a biocompatible material such as titanium, which is formed around the magnet 406. The biocompatible sealing of the coil 404 may be provided by its location within the wall of the transducer housing 314. Alternatively, a separate hermetic seal, such as for example the above-described gold plating or other means may be utilized to seal the coil 404 within the transducer housing 314. Alternatively, however, it will be appreciated that a sealing means, such as a bellows or other member with the ability to accommodate the vibrational movement of the tube 402, may be utilized in combination with the spring washer 400 to provide a seal at the ends 410 and 412 of the aperture 408.

Figure 17:
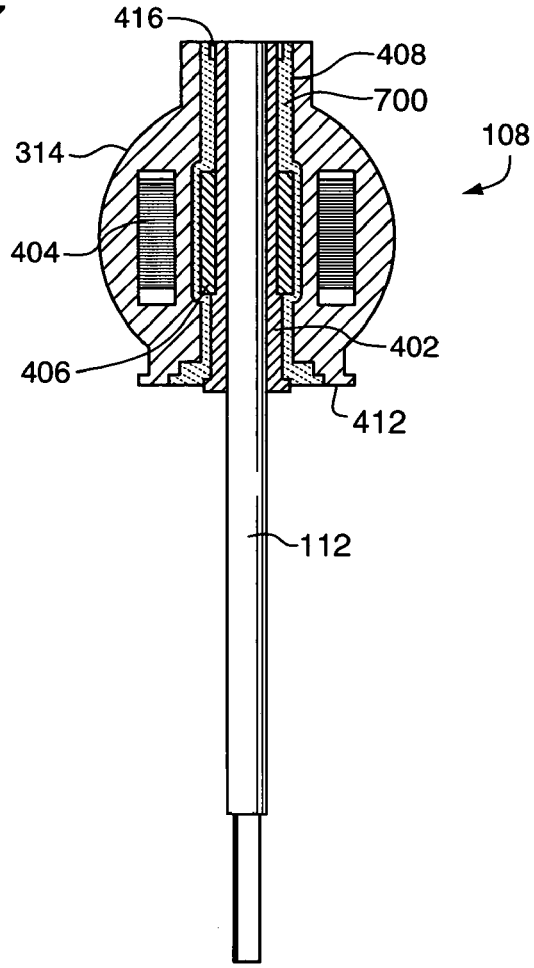
FIG. 17 illustrates a cross sectional view of another embodiment of an implantable transducer operational with the system of FIG. 3.

Referring to FIG. 17, in an alternative embodiment of the transducer 108, the movable connection between the tube 402 and the transducer housing 314 may be provided by a compliant member 700. According to this characterization, the compliant member 700 may be disposed within the aperture 408 between an interior wall of the transducer housing 314 and the tube 402. In the present context, the compliant member 700 may be any member that provides an axially movable connection between the tube 402 and the transducer housing 314. In one example, the compliant member 700 may be an elastomeric material such as a low durometer magnetically conductive silicon that is disposed within the aperture 408 around the tube 402. According to this characterization, the compliant member 700 may fill the void between the tube 402 and interior wall of the aperture 408 as illustrated on FIG. 17. Alternatively, however, the compliant member 700 may only partially fill the void between the tube 402 and interior wall of the aperture 408. For instance, the compliant member 700 may only be disposed in an area surrounding the magnet 406. In another instance, the compliant member 700 may only be disposed in an area at each end of the tube 402. In another instance, the compliant member 700 may only be disposed in an area at one end of the tube 402. In any case, it will be appreciated that the compliant member 700 may form both a movable and sealed connection of the tube 402 to the transducer housing 314, as a function of the location of the compliant member 700, such that a separate means for sealing the internal transducer components may not be required.

Figure 8:
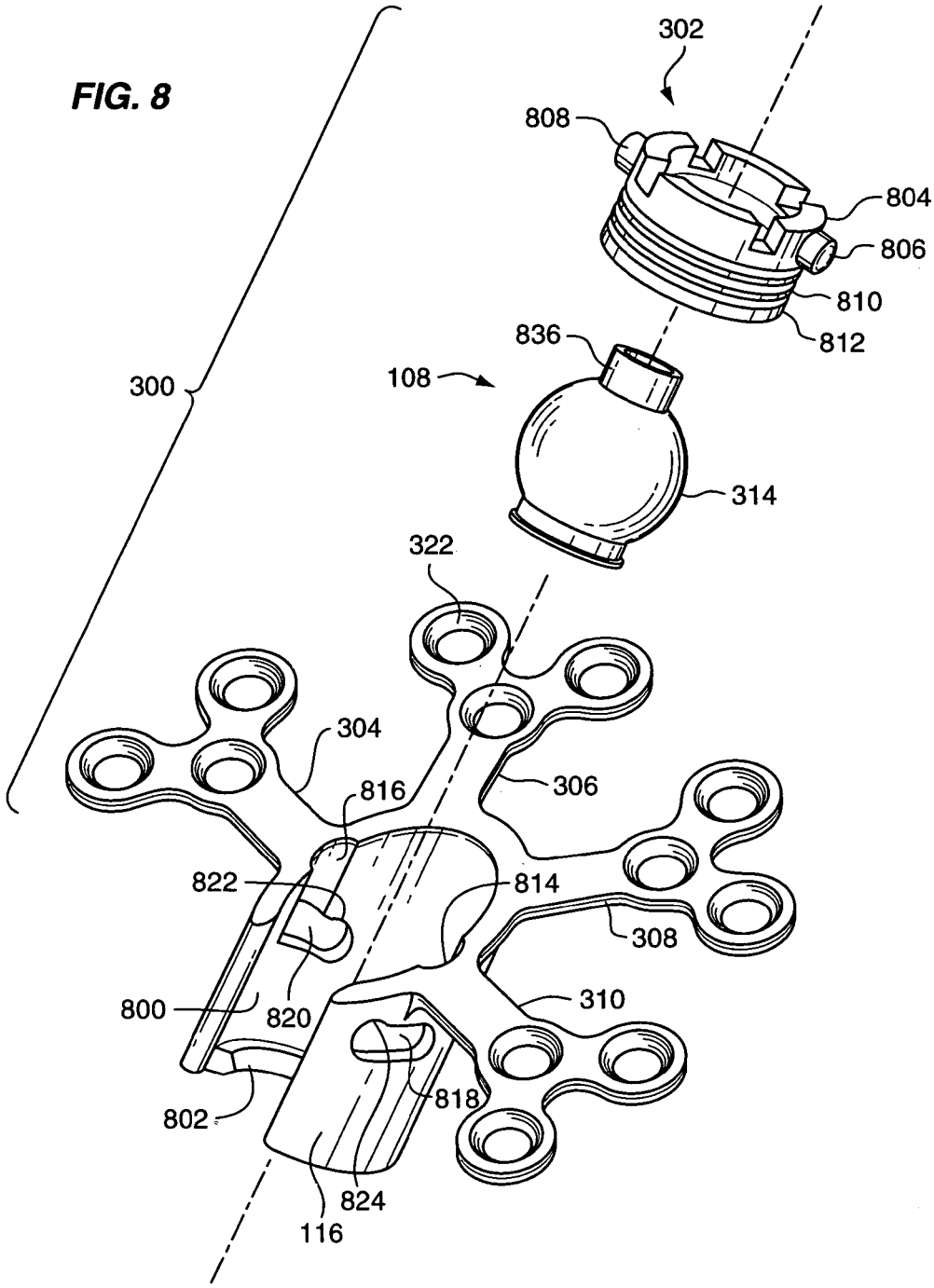
FIG. 8 illustrates an assembly view of the system of FIG. 3.

FIG. 8 depicts an assembly view of the transducer system 300 including the mounting apparatus 116, the transducer 108, and the retention apparatus 302. In this regard, the mounting apparatus 116 includes a cavity 800 appropriately sized to receive and supportably retain the transducer housing 314 in a rotatable manner. The cavity 800 includes a lip 802 that circumscribes a bottom edge of the cavity 800 to support the transducer housing 314 in a rotatable manner therein, when the housing 314 is located in the same. As further described below, the lip 802 also operates in combination with the retention apparatus 302, to frictionally capture the transducer housing 314 within the cavity 800 at a desired point in the implantation process. Preferably, the lip 802 is slightly tapered such that a mating relationship exists between the outer diameter of the rounded surface of the transducer housing 314 and the lip 802. This facilitates the rotational movement of the housing 314 within the cavity 800, as well as enhances the frictional force provided by the retention apparatus 302 by increasing the contact area between the housing 314 and the mounting apparatus 116.

Figure 9:
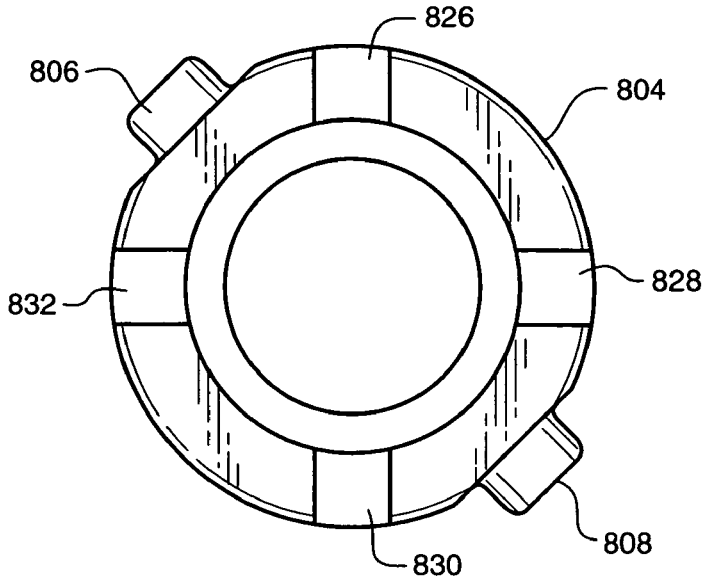
FIG. 9 illustrates a top view of a retention apparatus for the system of FIG. 3.
Figure 10:
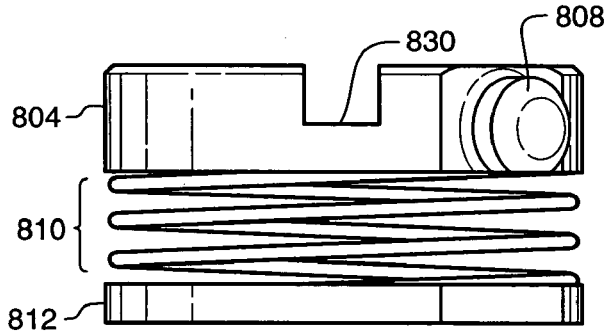
FIG. 10 illustrates a side view of the retention apparatus of FIG. 9.
Figure 11:
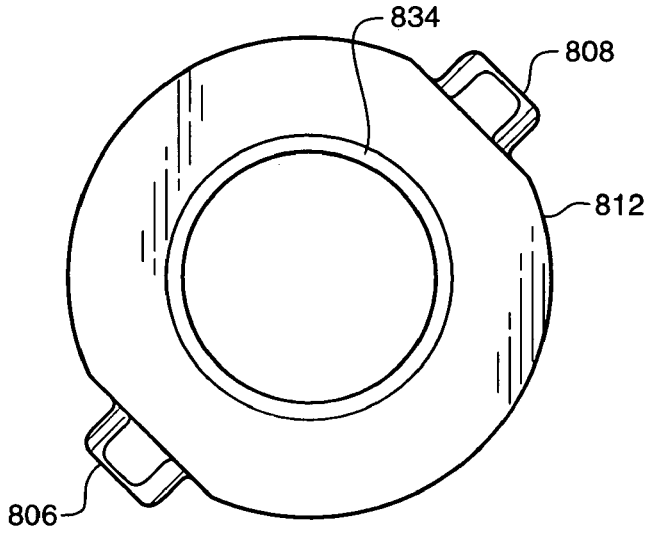
FIG. 11 illustrates a bottom view of the retention apparatus of FIG. 9.

Referring now to FIGS. 9–11, the retention apparatus 302 will be described in further detail. The retention apparatus 302 comprises a retaining member 804, a resilient member, e.g. spring 810, and a base 812. The retaining member 804 in turn includes a pair of diametrically opposed guides that are in the form of detents 806 and 808. The retention apparatus 302 is preferably constructed from a biocompatible material with some examples including without limitation, titanium, a titanium alloy, platinum, a platinum alloy, or gold-plated stainless steel.

Operationally, the detents 806 and 808 mate with longitudinal slots, 814 and 816, and lateral slots 818 and 820 in the mounting apparatus 116. The detents 806 and 808 operate to guide the retaining member 804 along a predetermined path of travel between a locked position of FIG. 3, and an unlocked position wherein the transducer housing 314 is only loosely constrained within the cavity 800. In this manner, the longitudinal slots 814 and 816 intersect the lateral slots 818, and 820 to provide a twist lock type connection between the retention apparatus 302 and the mounting apparatus 116. Advantageously, the twist lock type connection provides a quick and efficient means for fixing the angular position of the transducer housing 314 within the mounting apparatus 116. Similarly, the same is true with regard to releasing the transducer housing 314 from the mounting apparatus 116 to permit reorientation or removal from the mounting apparatus 116.

Continuing with the above example, following insertion of the transducer housing 314 into the cavity 800, the retention apparatus 302 is inserted such that the detents 806 and 808 travel along the longitudinal slots 814 and 816 until they come to rest at the bottom of the longitudinal slots 814 and 816. Preferably, in this position, the base 812 is resting on the transducer housing 314 but the spring 810 is not yet in a compressed state. Rather, compression of the spring 810 is provided as the retention apparatus 302 is rotated to move the detents 806 and 808 laterally within the lateral slots 818 and 820. In this regard, the lateral slots 818 and 820 extend laterally away from the longitudinal slots 816 and 814, and longitudinally downward toward the bottom of the cavity 800. In other words, the lateral slots 818 and 820 are sloped or ramped toward the bottom of the cavity 800 so that as the detents 806 and 808 travel along the slots 818 and 820 to the locked position, they move both laterally as well as longitudinally downward relative to the cavity 800 thereby compressing the spring 810 between the retaining member 804 and the base 812. This in turn applies pressure on the transducer housing 314 to compressively capture the same in the cavity 800 between the lip 802 and base 812.

To facilitate retentive locking of the retention apparatus 302, the lateral slots 818 and 820 preferably include a slight undercut in the areas 822 and 824. In this regard, as the detents 806 and 808 reach the end of the lateral slots 818 and 820 they snap slightly upward into the undercut areas 822 and 824 to lock the retention apparatus 302 relative to the mounting apparatus 116. Advantageously, this provides a positive engagement between the mounting apparatus 116 and the retention apparatus 302 and provides an indication, e.g. via a slight snap of the detents 806 and 808 into the undercut areas 822 and 824, to the surgeon or audiologist that the retention apparatus 302 is in the locked position. The positive engagement between the retention apparatus 302 and mounting apparatus 116 also reduces the probability that the retention apparatus 302 may become unlocked if the patient is subject to an abnormal shock event, such as a sever blow to the head.

To facilitate the locking and unlocking of the retention apparatus 302, the retaining member 804 may include notches 826, 828, 830 and 832 that permit use of a tool, as further explained below, to lock and unlock the retention apparatus 302. It will be appreciated in this regard, that the notches, e.g. 826, are a function of the type of tool, if any, utilized to lock and unlock the retention apparatus 302. Therefore, the exact geometry and number of notches may vary as a matter of choice.

The spring 810 may be any design that provides a predeterminable amount of frictional force on the transducer housing 314 to secure the same relative to the mounting apparatus 116. In one example, the spring 810 may be a coil spring design configured to apply a predetermined amount of compressive force on the transducer housing 314 within the cavity 800. In this regard, the constant of the spring 810 in combination with the slope and length of the lateral slots 818 and 820 may be altered to achieve varying amounts of compressive force on the transducer housing 314. In other words, by varying one or more of the slope and/or length of the lateral slots 818 and 820, the spring constant, and/or the combination thereof, the amount of compressive force and resulting frictional force between the transducer housing 314 and the mounting apparatus 116 may be varied. It will be appreciated, however, that while such forces may be varied across a broad range, wherein the transducer 108 is operational (e.g. is secure enough to maintain its ability to transmit vibrational energy to an auditory component), it is desirable to generate enough frictional force to maintain the position of the transducer housing 314 during and subsequent to abnormal shock events, such as the above mentioned severe blow to the head of the patient. Accordingly, in at least one example of the retention apparatus 302, it is desirable that the retention apparatus 302 be designed to maintain the position of the transducer housing 314 when the system is subject to a shock load at or below four (4) g's and preferably when the system is subject to a shock load at or below ninety (90) g's wherein a (g) is the acceleration due to gravity.

In a further feature of the retention apparatus 302, the base 812 may be altered to facilitate maintaining the positional relationship between the transducer housing 314 and the mounting apparatus 116. For instance, as with the lip 802, the base 812 may include a recessed beveled portion 834 to provide additional contact surface area between the transducer housing 314 and the base 812. In another instance, the beveled portion 834 and a mating portion of the transducer housing 314 may include a surface discontinuity, e.g. a roughed surface, designed to increase the frictional force therebetween. In still a further example of the retention apparatus 302, the surface 834 may include a traction layer. The traction layer may comprise a layer of material, such as rubber or other material having a high frictional coefficient or resistance to movement located on surface 834. Alternatively, it will be appreciated that a traction layer may also be included on the transducer housing 314 or on both the surface 834 and the housing 314 in mating relation.

Figure 12:
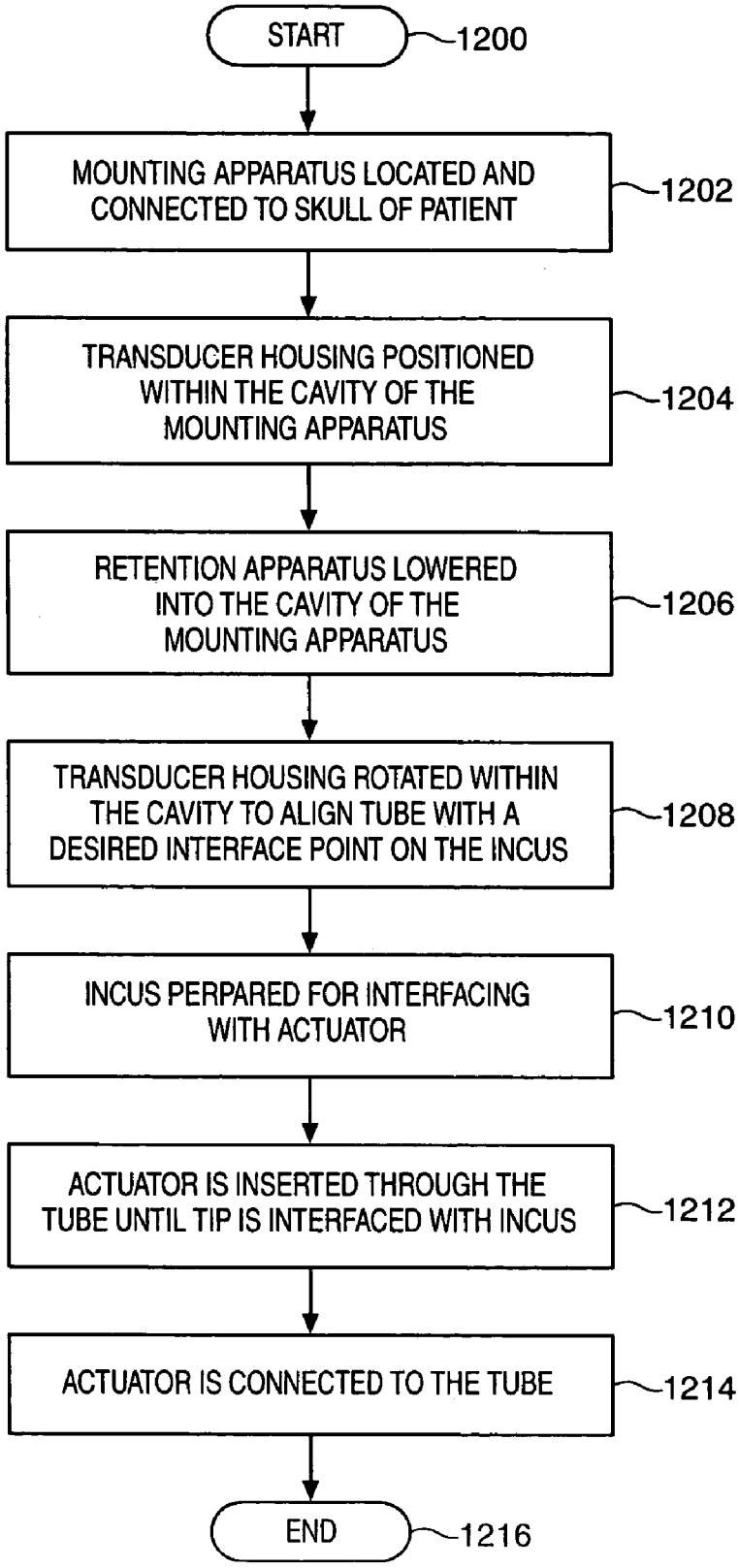
FIG. 12 is a flow chart illustrating an operational protocol for the system of FIG. 3.

FIG. 12 illustrates one example of an operational protocol for implanting the transducer system 300 in a patient. On FIG. 12, the operation begins at step 1200, with the preparation of the patient and forming of an opening in the mastoid process as conventionally performed in the art. At step 1202, the mounting apparatus 116 is located and connected, e.g. via bone screws, to the skull of the patient. The mounting apparatus 116 is preferably located and connected so that it substantially aligns with the ossicles of the middle ear. At step 1204, the transducer housing 314 may be positioned within the cavity 800 of the mounting apparatus 116. In this regard, the patient's head is preferably positioned, e.g. on its opposing side, so that the transducer housing 314 is loosely retained in the cavity 810 by gravitational forces. At step 1206, the retention apparatus 302 may also be lowered into the cavity 800 with the detents 806 and 808 located within the longitudinal slots 814 and 816. At step 1206, the transducer housing 314 is only loosely constrained by the retention apparatus 302, which is not yet in the locked position, but rather is only resting on the housing 314.

According to one example of the present protocol, at step 1206 the method may include rotating the transducer housing 314 to align the tube 402 with a desired interface point on the incus 120, followed by a subsequent locking or movement of the retention apparatus 302 to the locked position to maintain the desired alignment. Alternatively, however, the retention apparatus 302 may be moved to the locked position prior to aligning the tube 402 with the desired interface point.

Figure 13:
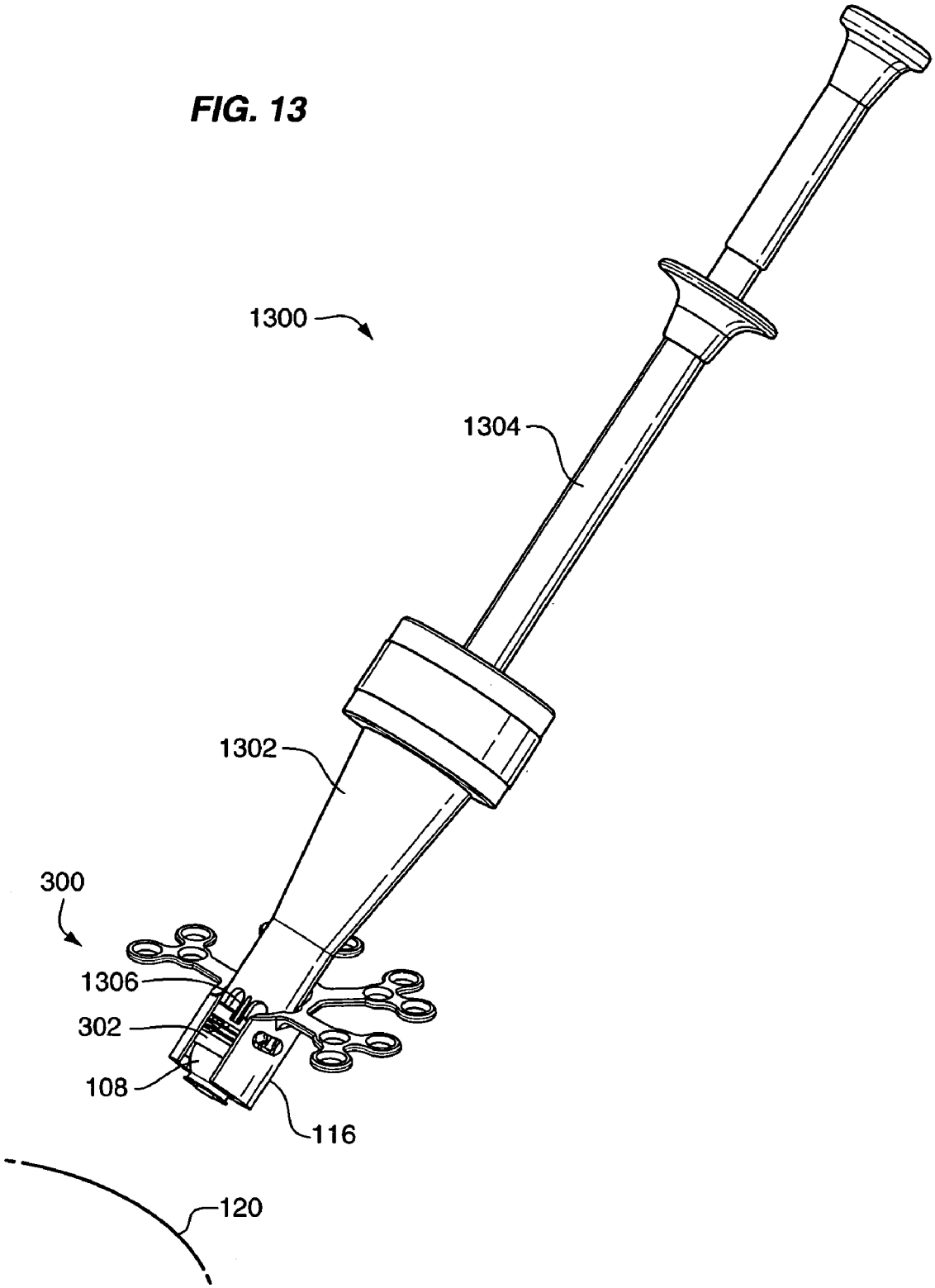
FIG. 13 illustrates additional details of the protocol of FIG. 12.
Figure 14:
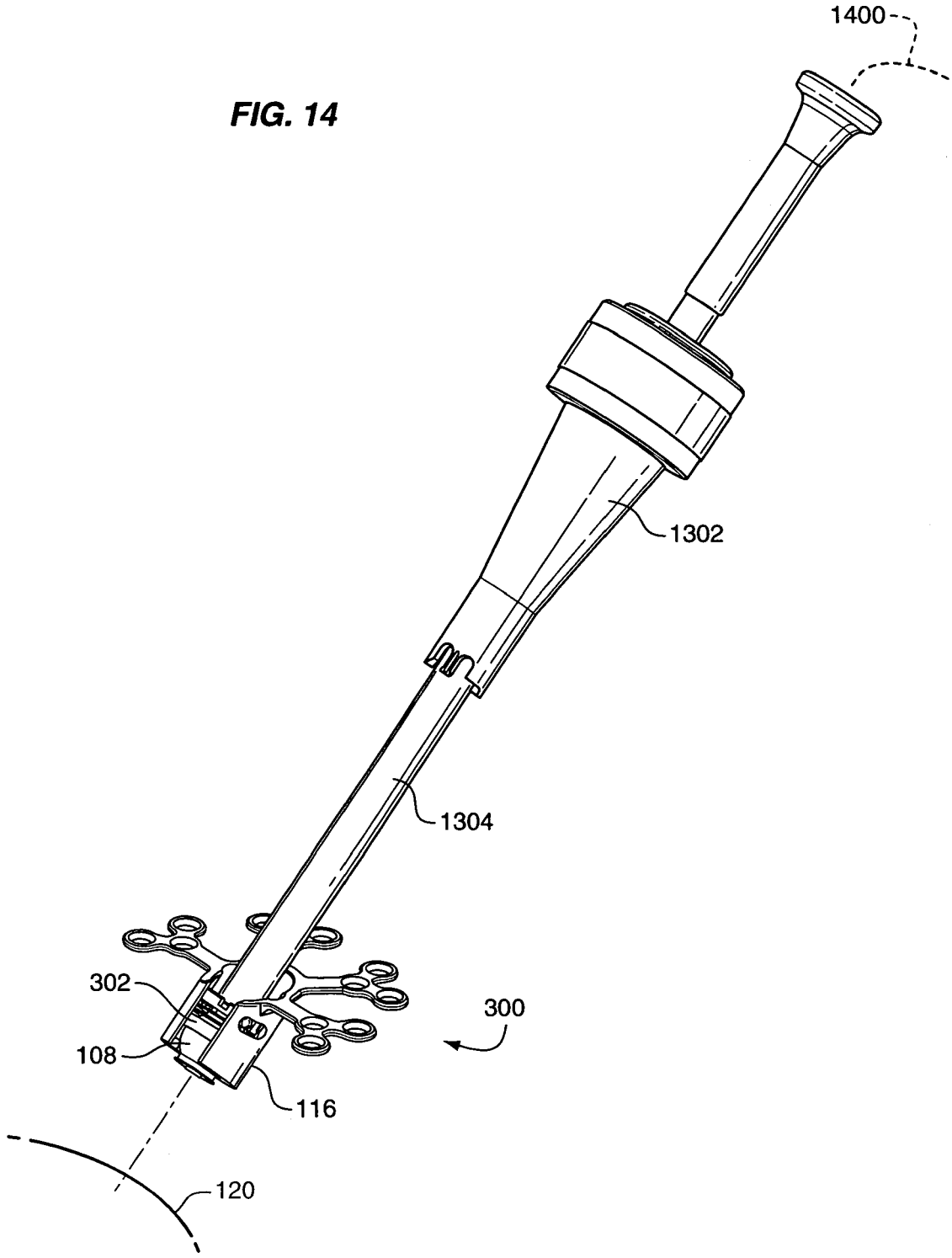
FIG. 14 illustrates additional details of the protocol of FIG. 12.

Referring also to FIG. 13, in either case, a tool such as tool 1300 may be utilized to align the transducer housing 314 and to lock the retention apparatus 302. Advantageously, the tool 1300 is configured to both orient the transducer housing 314 and lock the retention apparatus 302 without regard to the order that the two operations are performed. In this regard, the tool 1300 includes an annular member 1302 that is disposed over a shaft member 1304, so as to be both rotatable and slidable relative to the shaft 1304. The annular member 1302 includes teeth 1306 formed in its distal end that mate with notches 826, 828, 830 and 832 defined in the retaining member 804 of the retention apparatus 302. The teeth 1306, in turn facilitate movement of the retention apparatus 302 along the slots 818 and 820 between the unlocked position and locked position as the annular member 1302 is rotated about the shaft 1304. The shaft 1304, on the other hand, is configured at its distal end for engagement over a neck portion 836 (shown on FIG. 8) of the transducer housing 314. Once engaged over the neck 836, the shaft 1304 may be utilized to rotate the housing 314 within the cavity 800 to align the opening of the tube 402 with the desired interface point on the incus 120. In this regard, the annular member 1302 may be pulled back along the shaft 1304 as illustrated in FIG. 14 during alignment of the tube 402 to provide increased visibility and room from rotational movement of the shaft 1304. In this regard, the shaft 1304 provides sufficient leverage to rotate the transducer housing 314 within the cavity 800 even when the retention apparatus 302 is in the locked position.

Continuing with the above example, at step 1208, the transducer housing 314 may be rotated within the cavity 800 to align the tube 402 with a desired interface point on the incus 120. As noted, the transducer housing 314 may be oriented prior to locking the retention apparatus 302 or subsequent to locking the retention apparatus 302. Preferably, however, the retention apparatus 302 is moved to the locked position prior to orienting the transducer housing 314. This in turn simplifies the implantation procedure by reducing the workload. In other words, in the latter case, the surgeon may lock the retention apparatus 302 without regard to holding a desired orientation of the transducer housing 314. In the former case, however, the desired orientation of the transducer housing 314 achieved during the orientation step, must be maintained during the locking step.

In either case, to increase visibility for the surgeon, the annular member 1302 may be pulled back on the shaft 1304 away from the transducer system 300 during the orientation step. Furthermore, to facilitate the alignment of the tube 402, the shaft 1304 preferably includes a hollow core to permit the use of an alignment means. For instance, a laser guide 1400 may be inserted through the shaft 1304 to align the tube 402 with the desired interface point on the incus 120 (as shown in FIG. 14).

In an alternative example of steps 1202–1208, the transducer system 300 may be pre-assembled prior to implantation in the patient. In other words, the transducer housing 314 may be located in the mounting apparatus 116 and the retention apparatus 302 located in the same and moved to the locked position prior to implantation in the patient. The assembled components may then be implanted within the patient as a single unit, e.g. connected to the patient's skull. According to this characterization, the transducer housing 314 may then be oriented within the cavity 800 as described above using the tool 1300 to align the tube 402 with the desired interface point.

Figure 15:
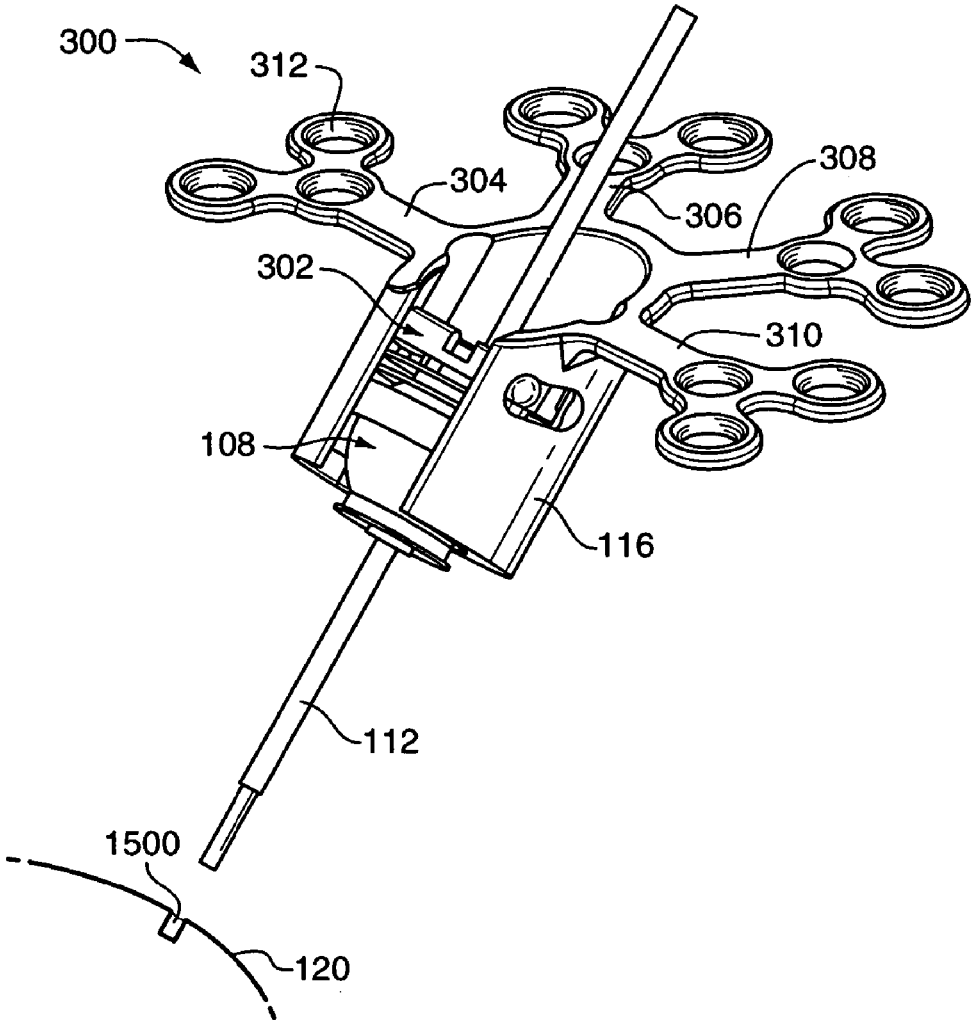
FIG. 15 illustrates additional details of the protocol of FIG. 12.

According to the above examples, once oriented, the tool 1300 may be removed at step 1210 and any requisite preparation of the incus 120 may be performed. For instance, as illustrated in FIG. 15, a shallow aperture 1500 may be formed in the incus 120 and utilized as an attachment interface for the actuator 112. Alternatively, interfacing with the incus 120 may be achieved through any suitable method, including adjacent positioning of the actuator 112 relative to the incus 120. Advantageously, however, where the aperture 1500 is utilized, the tube 402 may provide a convenient means for insertion and alignment of a device such as a laser drill to form the aperture 1500

At step 1212, the actuator 112 may be inserted through the tube 402, as illustrated in FIG. 15, until the tip is interfaced with the incus 120, e.g. seated in the aperture 1500. Advantageously, the present protocol minimizes loading forces on the incus 120 as only gravitational forces caused by the weight of the actuator 112, which is relatively negligible, are applied thereon subsequent to interfacing of the actuator 112. In other words, once the actuator 112 is inserted in the aperture 1500 and the insertion pressure released, any substantial loading pressures are also released and the incus 120 is able to move to an equilibrium position prior to connection of the actuator 112 to the tube 402. At step 1214, the actuator 112 may then be connected to the tube 402 using means 416 and the operation ends at step 1216. It should be noted however, that since the length of the actuator 112 controls the vertical relationship between the transducer housing 314 and the incus 120, it may be desirable to have available actuators of various lengths to accommodate biological variations between patients that result in different vertical distances. Alternatively, an actuator 112 may be of sufficient length to accommodate all patients and the excess length trimmed following connection to the tube 402.

As set forth herein, the transducer housing 314 may be configured in any shape or geometry that is rotatable relative to the mounting apparatus 116. For instance, as illustrated in the present example, the transducer housing 314 may comprise a rounded housing 314 rotatable within the cavity 800. In another embodiment, however, the transducer housing may be substantially round with a plurality of faucets or faces, such as on a diamond. According to this characterization, as the transducer housing is rotated each face may operate to positionally fix the housing along a continuum of positions as defined by the faucets. In another embodiment, only a portion of a transducer housing may be rounded for rotation, while a remaining portion is configured in another shape. In a further embodiment, a transducer housing may include substantially rounded opposing portions to permit rotation within the cavity 800. In this case, the substantially rounded opposing portions may have the same or a variety of different arc lengths or radii.

Figure 16:
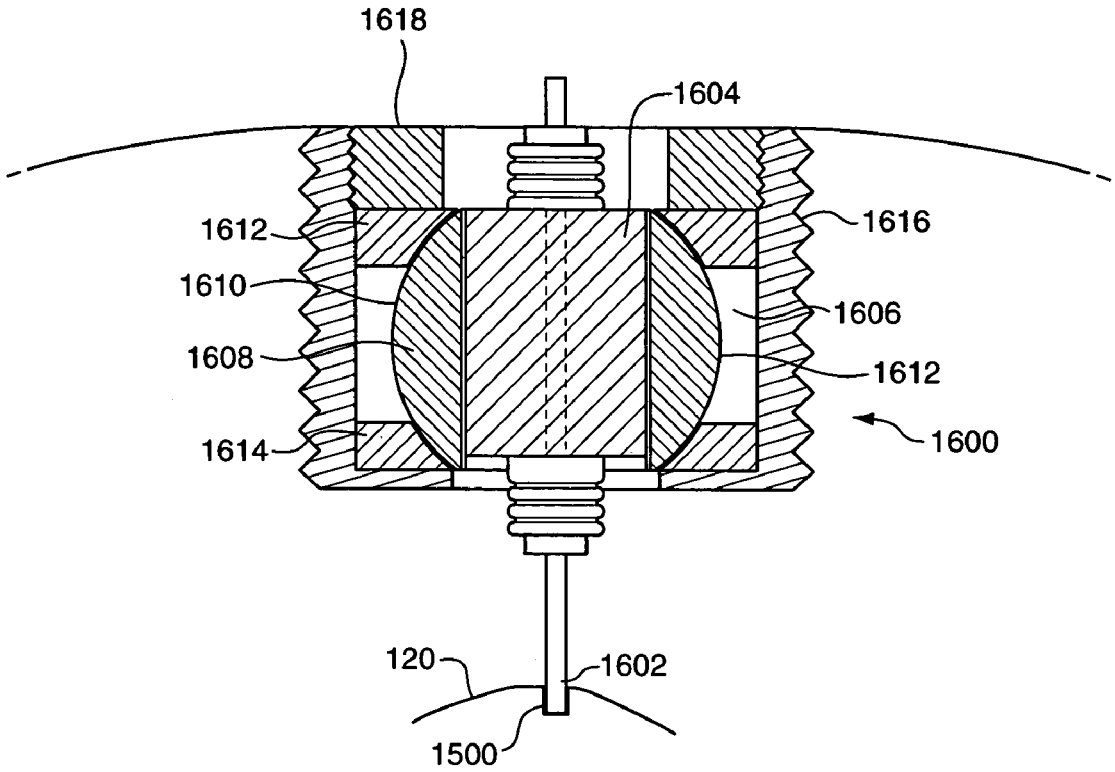
FIG. 16 illustrates another example of an implantable transducer system.

FIG. 16 illustrates another example of a transducer system according to the present invention, namely transducer system 1600. The system 1600 includes a mounting apparatus 1616 and a rotatable member 1608. According to this characterization, the rotatable member 1608 is designed to provide rotatable functionality relative to the mounting apparatus 1616 for a transducer 1604 that is not necessarily rotatable by its own design. The transducer 1604 may be similar to the transducer 108 in that it includes an actuator 1602 that is a separately insertable and connectable to the transducer housing.

The rotatable member 1608 may be any member configured to provide rotational movement of the transducer 1604 relative to the mounting apparatus 1616. For instance, the rotatable member 1608 may include two or more opposing rotatable portions, as exemplified by rotatable portions 1610 and 1612. In another instance, the rotatable member 1608 may include a single rotatable portion, such as a ball, having a substantially central cavity therein for supportably positioning the transducer 1604.

According to the present embodiment, the mounting apparatus 1616 includes a cavity 1606 for receiving the rotatable member 1608 and transducer 1604 therein. A bottom support member 1614 and top support member 1612 provide a framework for supporting the angular orientation of the rotatable member 1608 and transducer 1604 and positionally fixing the same upon achieving a desired angular orientation of the transducer 1604.

In this regard, the rotatable member 1608, is pivotable between the top and bottom support members, 1612 and 1614 to orient the transducer 1604 for interfacing with the incus 120. Once a desired angular orientation is achieved, a connector 1618 that is threadable into the top portion of the mounting apparatus 1616 compresses the rotatable member 1608 and transducer 1604 between the top and bottom support members 1612 and 1614 to maintain the desired orientation. In other words, the connector 1618 operates to secure, through compression, the rotatable member 1608 between the support members, 1612 and 1614. This in turn secures the transducer 1604 and fixes the position relative to a desired interface point on the incus 120.

Those skilled in the art will appreciate the numerous advantages provided by the present transducer systems. For instance, the present systems simplify implantation procedures for implantable transducers as they eliminate often-complicated positioning assemblies and minimize the surgical procedure required to locate and orient a transducer for interfacing with an auditory component. A related advantage is the reduction of foreign objects, e.g. through elimination of lateral and vertical positioning assemblies often utilized in the prior art. Another advantage is the improved accuracy and simplicity of transducer implantation and alignment, especially in regard to locating a desired actuator interface point through rotation of a transducer housing such that the actuator may thereafter be inserted through the body to interface with the precise identified desired location. In addition, potential overloading of the auditory component is minimized, as the weight of the actuator is substantially inconsequential. Furthermore, if loading does occur during interfacing of the actuator, the auditory component is able to compensate through movement of the actuator to an equilibrium state, once the pressure is released, prior to connection of the actuator to the transducer housing.

Those skilled in the art will appreciate variations of the above-described embodiments that fall within the scope of the invention. As a result, the invention is not limited to the specific examples and illustrations discussed above, but only by the following claims and their equivalents.

We claim:

1. An implantable hearing aid transducer mountable to a transducer mounting apparatus, the transducer comprising:

an actuator to stimulate an auditory component;

a driver comprising at least one magnet and at least one coil; and a transducer housing having a rotatable portion rotatable in three dimensions, said rotatable portion sunportedly housing at least a portion of one of the at least one magnet and the at least one coil of the driver, wherein at least part of the rotatable portion of the transducer housing is rotatable within and relative to a cavity of a transducer mounting apparatus, said at least part of the rotatable portion supportedly housing said one of the at least one magnet and the at least one coil of the driver, and wherein during three-dimensional rotation of the rotatable portion of the transducer housing a center of rotation of the rotatable portion of the transducer housing remains positionally fixed.

2. The transducer of claim 1 wherein the center of rotation of the rotatable portion of the transducer housing is located within the cavity of the transducer mounting apparatus.

3. The transducer of claim 1 wherein the transducer housing includes an aperture extending through at least a first side thereof, and wherein the actuator is advanceable through the aperture to interface with the auditory component.

4. The transducer of claim 3 wherein the rotatable portion of the transducer housing is rotatable to align one of an actuator axis and the aperture with a desired interface point on the auditory component.

5. The transducer of claim 3 wherein the actuator is a separate structure from the transducer housing that is insertable into and advanceable through the aperture.

6. The transducer of claim 3 wherein the aperture extends through a second side of the transducer housing.

7. The transducer of claim 6 comprising:

a tube movably connected within the aperture and configured to receive the actuator.

8. The transducer of claim 7 comprising:

a spring washer connecting the tube within the aperture in a movable manner.

9. The transducer of claim 7 wherein when the actuator is detachably connectable to the tube and the tube and actuator are movable by the driver relative to the transducer housing.

10. The transducer of claim 1 wherein the actuator is detachably connectable to the transducer housing along a continuum of linearly disposed positions.

11. The transducer of claim 1 wherein the rotatable portion of the transducer housing is substantially rounded for rotation relative to the transducer mounting apparatus.

12. The transducer of claim 1 wherein the rotatable portion of the transducer housing is selectively securable to the mounting apparatus along a continuum of angular orientations.

13. The transducer of claim 1 wherein at least one of the coil and the magnet is hermetically sealed within the transducer housing.

14. The transducer of claim 1 wherein at least one of the coil and the magnet is connected to the actuator in a hermetically sealed manner.

15. The transducer of claim 1, wherein the other one of said magnet and said coil is interconnected to said actuator for comovement therewith.

16. A method for implanting a hearing aid transducer within a patient, the method comprising:

attaching a transducer mounting apparatus to a patient's skull;

supporting at least part of a rotatable portion of a transducer housing within a cavity of the mounting apparatus said at least part of the rotatable portion supportedly housing at least a portion of a transducer driver, wherein the rotatable portion is rotatable in three dimensions and encloses at least said portion of the transducer driver; and rotating in three dimensions the rotatable portion of the transducer housing relative to the mounting apparatus to orient the transducer for interfacing with an auditory component, wherein during the rotating step, a center of rotation of the rotatable portion remains positionally fixed.

17. The method of claim 16 wherein the supporting step comprises locating the center of rotation of the rotatable portion within the cavity of the mounting apparatus, and the rotating step comprises rotating the rotatable portion within the cavity to a desired orientation relative to the auditory component.

18. The method of claim 17 the method comprising:

securing the rotatable portion of the transducer housing in the desired orientation relative to the auditory component.

19. The method of claim 18 wherein the securing step comprises:

securing the rotatably portion of the transducer housing in the desired orientation in a detachable manner.

20. The method of claim 16 wherein the rotating step comprises:

aligning at least one of an actuator axis and an aperture in the transducer housing with a desired interface point on the auditory component.

21. The method of claim 20 the method comprising:

inserting an actuator through the aperture in the transducer housing; and advancing the actuator through the aperture to interface the actuator with the auditory component.

22. The method of claim 21 the method comprising:

interfacing the actuator with the auditory component; and securing the actuator to the transducer housing.

23. The method of claim 20, wherein another portion of said transducer driver is interconnected to said actuator for comovement therewith.

24. A transducer system comprising:

a mounting apparatus attachable to a patient's skull;

a driver comprising at least one magnet and at least one coil;

a transducer housing having a rotatable portion rotatable in three dimensions, said rotatable portion supportedly housing at least a portion of one of the at least one magnet and the at least one coil of the driver, wherein at least part of the rotatable portion of the transducer housing is rotatable within and relative to a cavity of a transducer mounting apparatus said at least part of the rotatable portion supportedly housing said one of the at least one magnet and the at least one coil of the driver, and wherein during three-dimensional rotation of the rotatable portion of the transducer housing a center of rotation of the rotatable portion of the transducer housing remains positionally fixed; and a retention apparatus to selectively secure the rotatable portion of the transducer housing relative to the mounting apparatus.

25. The transducer system of claim 24 wherein the rotatable portion of the transducer housing is rotatable within the cavity to align one of an aperture in the transducer housing and an actuator axis with a desired interface point on an auditory member.

26. The transducer system of claim 24 wherein the rotatable portion of the transducer housing is rounded for rotation relative to the mounting apparatus.

27. The transducer system of claim 24 wherein the retention apparatus is selectively movable between a locked and unlocked position.

28. The transducer system of claim 27 wherein the rotatable portion of the transducer housing is rotatable, upon application of a predetermined amount of force, relative to the mounting apparatus, when the retention apparatus is in the locked position.

29. The transducer system of claim 27 wherein the retention apparatus comprises:

a retaining member;

at least one guide on the retaining member movable along a predetermined path of travel in the mounting apparatus between an unlocked and a locked position; and a resilient member compressible between the retaining member and a rotatable member to capture the rotatable member in a desired orientation relative to an auditory component when the retention apparatus is in the locked position.

30. The transducer system of claim 24 wherein the rotatable portion of the transducer housing is selectively securable to the mounting apparatus along a continuum of angular orientations.

31. The transducer system of claim 24 wherein the center of rotation of the rotatable portion of the transducer housing is located with the cavity of the mounting apparatus.

32. The transducer system of claim 24, wherein the other one of said magnet and said coil is interconnected to said actuator for comovement therewith.

33. A method for implanting a hearing aid transducer within a patient, the method comprising:

angularly orienting the transducer relative to a transducer mounting apparatus using rotational movement of a rotatable portion of a transducer housing, said transducer comprising a driver, wherein at least part of said rotatable portion is rotatable within and relative to a cavity of a transducer mounting apparatus, wherein said at least part of the rotatable portion supportedly houses at least a portion of the driver; and vertically orienting the transducer using an actuator advanceable relative to the transducer housing; and interfacing the actuator with an auditory component.

34. The method of claim 33 the method comprising:

connecting the actuator to the transducer housing.

35. The method of claim 33 wherein the angularly orienting step comprises:

rotating the rotatable portion of the transducer housing within a cavity of the mounting apparatus.

36. The method of claim 33 the method comprising:

securing the rotatable portion of the transducer housing within the mounting apparatus in the desired angular orientation.

37. The method of claim 36 wherein the vertically orienting step comprises:

inserting an actuator through an aperture in the transducer housing; and advancing the actuator through the aperture to interface the actuator with the auditory component.

* * * * *

UNITED STATES PATENT AND TRADEMARK OFFICE

CERTIFICATE OF CORRECTION

PATENT NO. : 7,153,257 B2
APPLICATION NO. : 10/821447
DATED : December 26, 2006
INVENTOR(S) : Schneider et al.

It is certified that error appears in the above-identified patent and that said Letters Patent is hereby corrected as shown below:

Column 3
Line 1, delete “ossicies” and insert therefor --ossicles--.

Column 18
Line 56, delete “sunportedly” and insert therefor --supportedly--.

Signed and Sealed this

Twenty-seventh Day of March, 2007

JON W. DUDAS
*Director of the United States Patent and Trademark Office*